US009381611B2

(12) United States Patent
Goto et al.

(10) Patent No.: US 9,381,611 B2
(45) Date of Patent: Jul. 5, 2016

(54) SURFACE TREATMENT DEVICE AND SURFACE TREATMENT METHOD FOR LONG WIRELIKE ARTICLE

(75) Inventors: Katsuhiro Goto, Hashima (JP); Tatsuya Banno, Hashima (JP); Nobuhiro Kanazawa, Hashima (JP)

(73) Assignee: FUJI SHOJI CO., LTD., Hashima-shi (JP)

( * ) Notice: Subject to any disclaimer, the term of this patent is extended or adjusted under 35 U.S.C. 154(b) by 194 days.

(21) Appl. No.: 14/346,857

(22) PCT Filed: Nov. 2, 2011

(86) PCT No.: PCT/JP2011/075271

§ 371 (c)(1), (2), (4) Date: Mar. 24, 2014

(87) PCT Pub. No.: WO2013/065138

PCT Pub. Date: May 10, 2013

(65) Prior Publication Data

US 2014/0213149 A1 Jul. 31, 2014

(51) Int. Cl.

| | |
|---|---|
| ***B24B 31/00*** | (2006.01) |
| ***B24B 1/00*** | (2006.01) |
| ***B24B 27/00*** | (2006.01) |

(Continued)

(52) U.S. Cl.

CPC ..... *B24B 31/003* (2013.01); *B24B 1/00* (2013.01); *B24B 27/00* (2013.01); *B24C 3/32* (2013.01); *B24C 3/327* (2013.01); *B21C 43/04* (2013.01); *B24B 31/0206* (2013.01); *B24C 3/081* (2013.01)

(58) Field of Classification Search

CPC ..... B21C 43/02; B21C 43/04; B24C 3/081; B24B 31/003; B24B 31/0206

See application file for complete search history.

(56) References Cited

U.S. PATENT DOCUMENTS 801,403 A * 10/1905 Rupley ..... B21C 43/00 29/90.5
3,526,059 A * 9/1970 Trimarchi ..... B24B 31/0206 451/68

(Continued)

FOREIGN PATENT DOCUMENTS

CN 1817565 A 8/2006
JP 49 78995 7/1974

(Continued)

OTHER PUBLICATIONS

Combined Chinese Office Action and Search Report issued Oct. 9, 2015 in Patent Application No. 201180074324.4 (with English language translation).

(Continued)

*Primary Examiner* — Timothy V Eley
(74) *Attorney, Agent, or Firm* — Oblon, McClelland, Maier & Neustadt, L.L.P.

(57) ABSTRACT

A surface treatment device and a surface treatment method for a long wirelike article, capable of grinding the surface of the long wirelike article efficiently with powder by cyclically repeating pressing and release of an elastic tube filled with the powder. At least one surface treatment unit includes a tube filled with powder which can be supplied to and discharged from the tube, and having a long wirelike article movably passing through the powder, a pressing mechanism for cyclically pressing and releasing the tube, and a feed mechanism for moving the long wirelike article passing through the powder.

7 Claims, 3 Drawing Sheets

(51) Int. Cl.

| | |
|---|---|
| ***B24C 3/32*** | (2006.01) |
| *B24B 31/02* | (2006.01) |
| *B24C 3/08* | (2006.01) |
| *B21C 43/04* | (2006.01) |

(56) References Cited

U.S. PATENT DOCUMENTS

| | | | | |
|---|---|---|---|---|
| 3,691,692 | A * | 9/1972 | Strohmeier | B24B 31/0206 451/107 |
| 3,906,672 | A * | 9/1975 | Kobayashi | B21C 43/00 451/102 |
| 4,660,326 | A * | 4/1987 | Petkov | B24B 29/08 451/104 |
| 5,121,573 | A * | 6/1992 | Vassena | B21C 43/04 451/312 |
| 7,021,998 | B2 | 4/2006 | Umemura et al. | |
| 7,422,512 | B2 * | 9/2008 | Umemura | B24B 7/12 451/36 |

FOREIGN PATENT DOCUMENTS

| | | |
|---|---|---|
| JP | 51 160293 | 12/1976 |
| JP | 2002 18717 | 1/2002 |
| JP | 2002 307288 | 10/2002 |

OTHER PUBLICATIONS

International Search Report Issued Jan. 17, 2012 in PCT/JP11/075271 Filed Nov. 2, 2011.

* cited by examiner

| | Δt | 2Δt | 3Δt | 4Δt | ------ |
|---|---|---|---|---|---|
| 1st Surface Treatment Unit | Release | Press | Press | Release | ------ |
| 2nd Surface Treatment Unit | Press | Release | Press | Press | ------ |
| 3rd Surface Treatment Unit | Press | Press | Release | Press | ------ |

SURFACE TREATMENT DEVICE AND SURFACE TREATMENT METHOD FOR LONG WIRELIKE ARTICLE

TECHNICAL FIELD

The present invention relates to a surface treatment device and surface treatment method for a long wirelike article and particularly, to a surface treatment device and a surface treatment method for a long wirelike article by which the surface of the long wirelike article as bead wire used for automobile tires is ground and processed by the use of powder.

BACKGROUND ART

A long wirelike article such as bead wire used for automobile tires is subjected to a heat treatment and a plating treatment after being wiredrawn to a predetermined wire diameter. In an processing method of this kind, a descaling step of removing oxide films that adhered to the surface of the long wirelike article during the heat treatment is required as a preceding step for the plating treatment.

As the surface treatment method for the long wirelike article, generally, the mainstream therefor is a pickling and removal method that chemically uses acid like hydrochloric acid. Recently, as described in Patent Document 1 for example, there is known, as eco-friendly method, a method for grinding the surface of a long wirelike article with powder having a grinding function by making the long article pass through an elastic chamber filled with the powder and by pressurizing the chamber by pressurized gas or pressurized liquid.

PRIOR ART DOCUMENT

Patent Document

Patent Document 1: JP 2002-18717 A

SUMMARY OF THE INVENTION

Problem to be Solved by the Invention

However, one described in Patent Document 1 is constructed so that the pressurized gas or the pressurized liquid is supplied by a pressurizing pump into an elastic chamber 6 filled with powder 4, that the powder 4 and the surface of a long wirelike article W are continued to be pressed through the chamber 6 and that in that state, the long wirelike article is made to pass through the chamber to grind the surface of the long wirelike article with the powder.

Thus, in the one described in Patent Document 1, a problem arises in that the persistence of the grinding effect by the powder is insufficient because the continuous pressurization of the chamber results in impeding the fluidities of fine powder fragmented by the grinding from the powder and extraneous matter cut away form the surface of the long wirelike article.

The present invention has been made taking the foregoing problem in the prior art into consideration, and an object thereof is to provide a surface treatment device and a surface treatment method for a long wirelike article, being capable of efficiently grinding the surface of the long wirelike article with powder by cyclically repeating the pressing and release of an elastic tube filled with the powder.

Solution to the Problem

The feature of the invention according to a first aspect resides in a surface treatment device for a long wirelike article for performing a surface treatment on the long wirelike article movably passing through powder that is filled in a tube to be supplied to and discharged from the tube, wherein the surface treatment device has at least one surface treatment unit and wherein the surface treatment unit comprises the tube filled with the powder that can be supplied to and discharged from the tube, and having the long wirelike article movably passing through the powder; pressing means for cyclically pressing and releasing the tube; and feed means for moving the long wirelike article passing through the powder.

The feature of the invention according to a second aspect resides in the surface treatment device for the long wirelike article in the first aspect, wherein the pressing means includes a cylinder that presses and compresses the tube.

The feature of the invention according to a third aspect resides in the surface treatment device for the long wirelike article in the second aspect, wherein the pressing means comprises a pair of cylinders arranged to face with the tube put therebetween; pressing members operated by the cylinders for pressing the tube from both sides; and restriction members arranged in a direction crossing a pressing direction of the pressing members for restricting the expansion of the tube.

The feature of the invention according to a fourth aspect resides in the surface treatment device for the long wirelike article in any one of the first to third aspects, wherein the at least one surface treatment unit comprises a plurality of surface treatment units arranged in a longitudinal direction of the tube; and that the respective pressing means in the surface treatment units are constructed to be subjected to pressing and release at mutually different timings.

The feature of the invention according to a fifth aspect resides in the surface treatment device for the long wirelike article in the fourth aspect, wherein the respective cylinders in the plurality of surface treatment units are arranged at different angles around the tube.

The feature of the invention according to a sixth aspect resides in a surface treatment method for a long wirelike article for performing a surface treatment on the long wirelike article movably passing through powder that is filled in a tube to be supplied to and discharged from the tube, wherein the method includes cyclically repeating the pressing and release of the tube to grind the surface of the long wirelike article with the powder filled in the tube.

Effects of the Invention

According to the invention of the first aspect, the at least one surface treatment unit is provided, and the surface treatment unit comprises the tube filled with the powder that can be supplied to and discharged from the tube, and having the long wirelike article movably passing through the powder; the pressing means for cyclically pressing and releasing the tube; and the feed means for moving the long wirelike article passing through the powder. Thus, by the cyclic release operation of the tube, fine powder fragmented by the grinding from the powder and extraneous matter cut away from the surface of the long wirelike article are enhanced in fluidity, so that it is possible to efficiently grind the surface of the long wirelike article with the powder being always good in sharpness.

In addition, since the cyclic pressing on the tube makes it possible to grind the surface of the long wirelike article most efficiently at the time of the pressing, the surface treatment of the long wirelike article with the powder can be performed further efficiently.

Furthermore, since the construction is taken that one surface treatment unit performs the surface treatment on the long wirelike article, it is possible to downsize and lighten the surface treatment device and hence, to reduce the cost in manufacturing.

According to the invention of the second aspect, since the pressing means includes the cylinder that presses and compresses the tube, the cyclic pressing and release of the tube can easily be performed by the cylinder.

According to the invention of the third aspect, the pressing means comprises the pair of cylinders arranged to face with the tube put therebetween; the pressing members operated by the cylinders for pressing the tube from both sides; and the restriction members arranged in the direction crossing the pressing direction of the pressing members for restricting the expansion of the tube. Thus, the restriction members can restrict the expansion operation of the tube in the direction being orthogonal to the pressing direction, the expansion operation resulting from the pressings on the tube by the pressing members, so that the tube can be pressed at the whole circumference thereof by the pressings of the pressing members operated by the pair of cylinders.

According to the invention of the fourth aspect, the at least one surface treatment unit comprises the plurality of surface treatment units arranged in the longitudinal direction of the tube, and the respective pressing means in the surface treatment units are constructed to be subjected to pressing and release at the mutually different timings. Therefore, even if the surface of the long wirelike article cannot be ground sufficiently by one surface treatment unit, the surface of the long wirelike article can be ground completely over the entire length by the grinding operations of other surface treatment units.

According to the invention of the fifth aspect, since the respective cylinders in the plurality of surface treatment units are arranged at different angles around the tube, the places that the pressing members press particularly strongly change in the circumference direction, so that it is possible to grind the long wirelike article uniformly in the circumferential direction.

According to the invention of the sixth aspect, since the surface of the long wirelike article can be ground with the powder by cyclically repeating the pressing and release of the elastic tube filled with the powder, fine powder fragmented by the grinding from the powder and extraneous matter cut away from the surface of the long wirelike article are enhanced in fluidity by the cyclic release operation of the tube, and hence, it is possible to grind the surface of the long wirelike article efficiently with the powder being always good in sharpness.

In addition, since the tube is pressed cyclically, the surface of the long wirelike article can be ground most efficiently at the time of the pressing. Thus, the surface treatment on the long wirelike article with the powder can be performed further efficiently.

EMBODIMENTS FOR PRACTICING THE INVENTION

Hereafter, a surface treatment device for a long wirelike article in a first embodiment according to the present invention will be described with reference to the drawings.

Figure 1:
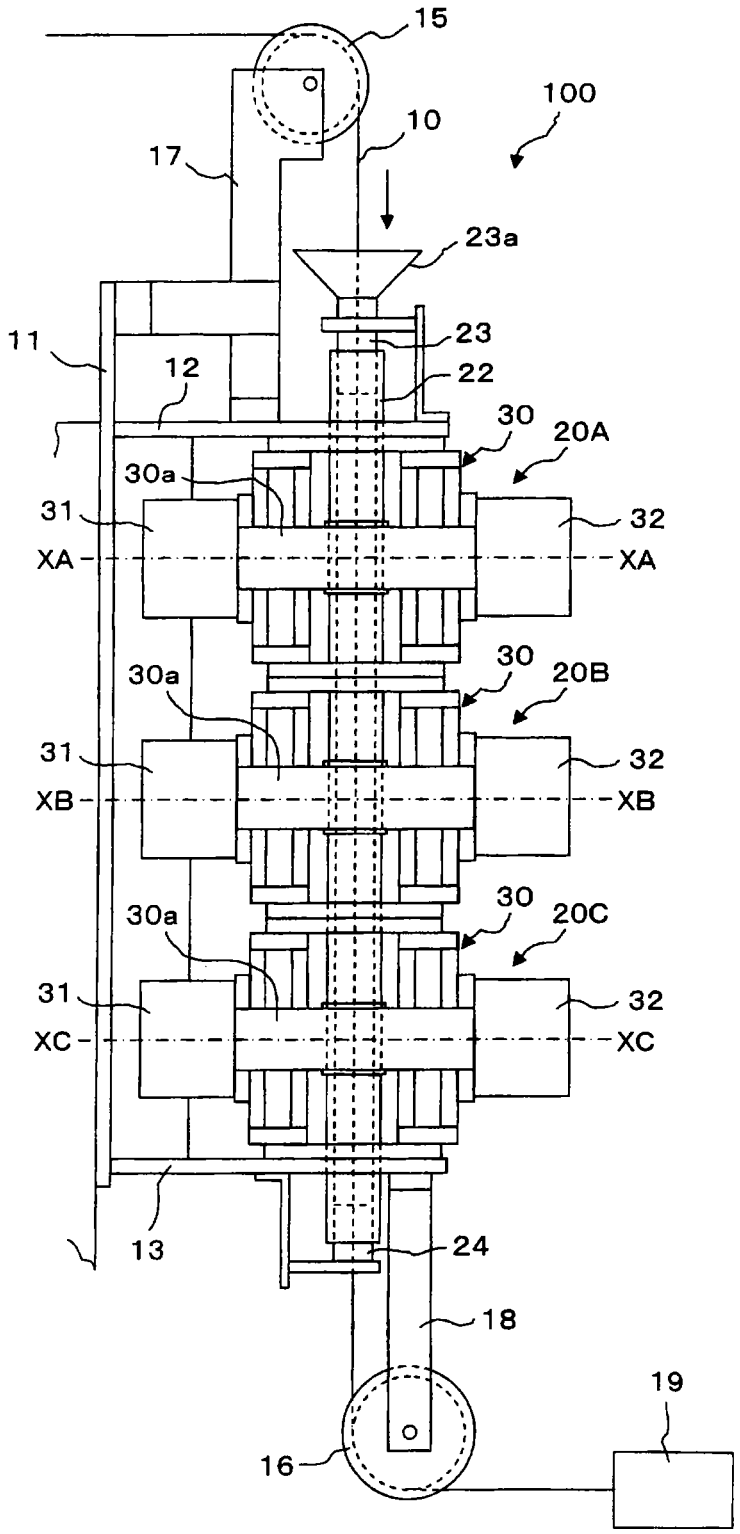
FIG. 1 is a general view showing a surface treatment device for a long wirelike article in a first embodiment according to the present invention.

FIG. 1 shows a general view of the surface treatment device 100 that performs a surface treatment to remove oxide films adhered to the surface of the long wirelike article 10 such as bead wire. The surface treatment device 100 has a base frame 11 installed at a fixed portion, and an upper support frame 12 and a lower support frame 13 that horizontally extend with a space therebetween in a vertical direction are fixed on the base frame 11. Between the upper and lower support frames 12, 13, three surface treatment units 20A, 20B, 20C (hereinafter, called first, second and third treatment units 20A, 20B, 20C) of the constructions referred to later are arranged to be aligned in series in the vertical direction.

Figure 2:
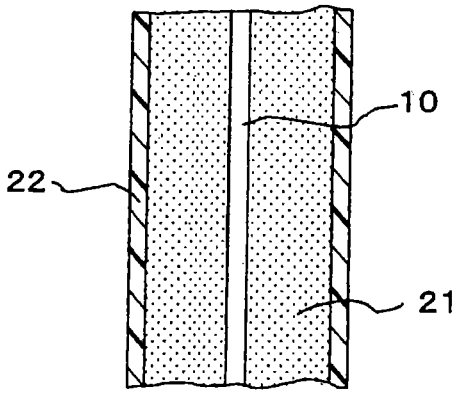
FIG. 2 is a schematic view showing a state that the long wirelike article passes through powder filled in an elastic tube.
Figure 3:
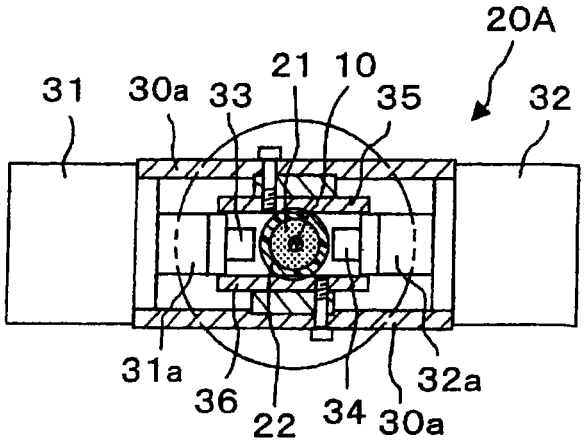
FIG. 3 is a sectional view taken along the line XA-XA in FIG. 1.

As shown in FIGS. 2 and 3, a tube 22 comprising an elastic vinyl hose that is filled with powder (grinding powder) 21 having a grinding function vertically passes through the center portions of the three surface treatment units 20A, 20B, 20C. The long wirelike article 10 to be subjected to a surface treatment passes through the center portion of the tube 22 to be able to go through in the vertical direction with its whole circumference being in contact with the powder 21.

To the upper support frame 12, a supply pipe 23 for supplying the powder 21 is secured in a vertical axis direction, while to the lower support frame 13, a discharge pipe 24 for discharging the powder 21 is secured on the same axis as the supply pipe 23. The upper portion of the supply pipe 23 is enlarged to take a funnel shape 23*a* so that the supply of the powder 21 becomes easy, and the powder 21 is properly supplied from a powder tank (not shown) into the supply pipe 23. For example, the powder 21 is made of alumina and is 0.2 mm or so in diameter. The particle diameter of the powder 21 is suitably determined in dependence on the wire diameter of the long wirelike article 10 to be subjected to surface treatment.

Between the supply pipe 23 and the discharge pipe 24, the tube 22 is arranged to vertically penetrate the center portions of the first, second and third surface treatment units 20A, 20B, 20C. One end of the tube 22 is connected to the supply pipe 23, and the other end of the tube 22 is connected to the discharge pipe 24.

The upper and lower support frames 12, 13 respectively secure thereto support blocks 17, 18 that rotatably support pulleys 15, 16 guiding the long wirelike article 10. The long wirelike article 10 passes through the supply pipe 23, the tube 22 and the discharge pipe 24 with itself guided by the pulleys 15, 16 and is continuously moved by feed means 19 in the powder 21 filled in the tube 22, at a predetermined speed.

Next, description will be made regarding the constructions of the first, second and third surface treatment units 20A, 20B, 20C. The three surface treatment units 20A, 20B, 20C are basically the same in construction, and thus, the first surface treatment unit 20A will be described hereafter.

The first surface treatment unit 20A has a unit main body 30 that comprises a box body having the tube 22 passing therethrough, and a pair of air cylinders 31, 32 as pressing means that are arranged on both sides in a horizontal XA direction with the tube 22 put therebetween and that are arranged on the unit main body 30.

As shown in FIG. 3, to respective piston rods 31*a*, 32*a* of the air cylinders 31, 32, there are respectively attached pressing members 33, 34 for pressing the tube 22 from both sides. A pair of restriction members 35, 36 for restricting the expansion of the tube 22 are arranged in a direction perpendicular to the pressing members 33, 34 and are secured to a bracket 30*a* secured to the unit main body 30.

Respective piston rods 31*a*, 32*a* of the air cylinders 31, 32 are cyclically advanced or retreated in a synchronized relation with each other. The piston rods 31*a*, 32*a* press and compress the tube 22 from both sides by the pair of pressing members 33, 34 when advanced, and release the tube 22 when retracted. In this case, when pressed in the XA direction by the pair of pressing members 33, 34, the tube 22 is compressed in the XA direction and is urged to be deformed to expand horizontally in a horizontal direction orthogonal to the XA direction. However, since the pair of restriction members 35, 36 are arranged in the direction orthogonal to the pair of pressing members 33, 34, the tube 22 is restricted from expanding.

The pressing operation on the tube 22 by the pressing members 33, 34 and the expansion restriction operation of the tube 22 by the restriction members 35, 36 cause the tube 22 to be pressed over the whole circumference. Therefore, since the powder 21 filled in the tube 22 and the surface of the long wirelike article 10 are pressed equally, the surface of the long wirelike article 10 that is moved in the powder 21 at a predetermined speed is cut away (ground) with the powder 21 through the movement relative to the powder 21.

Figure 4:
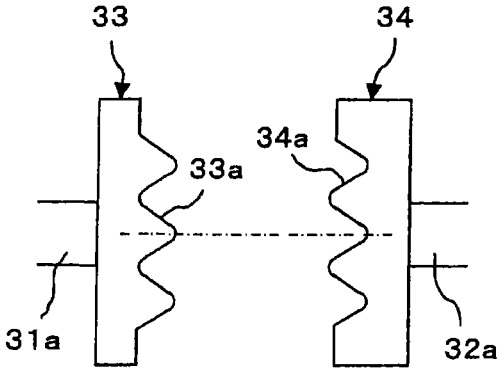
FIG. 4 is a schematic view showing an example of pressing members.

In this case, the pressing surfaces of the pressing members 33, 34 may be formed not as simple plane surfaces but as overlapping uneven shapes 33*a*, 34*a* as shown in FIG. 4. As a result, when the tube 22 is pressed, the powder 21 in the tube 22 can be effectively pressurized to be brought into the pressure contact with the surface of the long wirelike article 10, so that it becomes possible for the powder 21 to efficiently grind the surface of the long wirelike article 10.

Like this, as the tube 22 filled with the powder 21 is compressed, the surface of the long wirelike article 10 passing through the tube 22 is ground with the powder 21. In addition, since the pressing and release of the tube 22 are repeated cyclically, the releasing of the tube 22 results in enhancing the fluidities of fine powder fragmented by the grinding from the powder 21 and extraneous matter cut away from the surface of the long wirelike article 10. Therefore, the surface of the long wirelike article 10 is ground efficiently and accuracy with the powder 21 being always good in sharpness.

That is, the powder 21 can grind the surface of the long wirelike article 10 most efficiently when the tube 22 is pressed. Thus, in comparison with the case that the tube 22 is continued to be pressed simply, the cyclic repetition of the pressing and release of the tube 22 makes it possible to efficiently treat the surface of the long wirelike article 10 and at the same time, results in enhancing the fluidities of the fragmented fine powder and the extraneous matter.

Although taking the same construction as that of the aforementioned first surface treatment unit 20A, the second and third surface treatment units 20B, 20C differ in the following respects.

That is, the pressing direction of the tube 22 (the arrangement direction of the air cylinders 31, 32) by the pair of air cylinders 31, 32 in the second surface treatment unit 20B is in an angular direction (XB direction) that differs at 120 degrees clockwise in angular phase as viewed in FIG. 3 from that in the first surface treatment unit 20A. Further, the pressing direction of the tube 22 by the pair of air cylinders 31, 32 in the third surface treatment unit 20C is in an angular direction (XC direction) that further differs at 120 degrees clockwise in angular phase as viewed in FIG. 3 from that in the second surface treatment unit 20B.

Although in FIG. 1, the respective air cylinders 31, 32 of the first to third treatment units 20A-20C are illustrated as if all are arranged in the same plane, the pressing directions (XA direction, XB direction, XC direction) in the respective surface treatment units 20A-20C differ at 120 degree intervals from one another, as mentioned above.

Like this, the tube 22 is pressed by the three surface treatment units 20A-20C at angles that differ in turn from one another, so that the surface of the long wirelike article 10 is ground with the powder 21 uniformly in the circumferential direction. That is, even if the expansion restriction operation against the tube 22 by the restriction members 35, 36 causes the tube 22 to be pressed over the whole circumference, the tube 22 is strongly pressed particularly in the direction in which the pressing members 33, 34 exert the pressings. Therefore, as a result of the pressing directions being shifted in angle, the surface of the long wirelike article 10 is pressed uniformly in the circumferential direction and thus, is ground uniformly in the circumferential direction.

The pressing and release operations of the tube 22 by the air cylinders 31, 32 are performed by the three surface treatment units 20A-20C at respective timings that are shifted at a time interval Δt. That is, the tube 22 is pressed by the three surface treatment units 20A-20C at different timings to be neither pressed simultaneously nor released simultaneously.

Figures 5, 6:
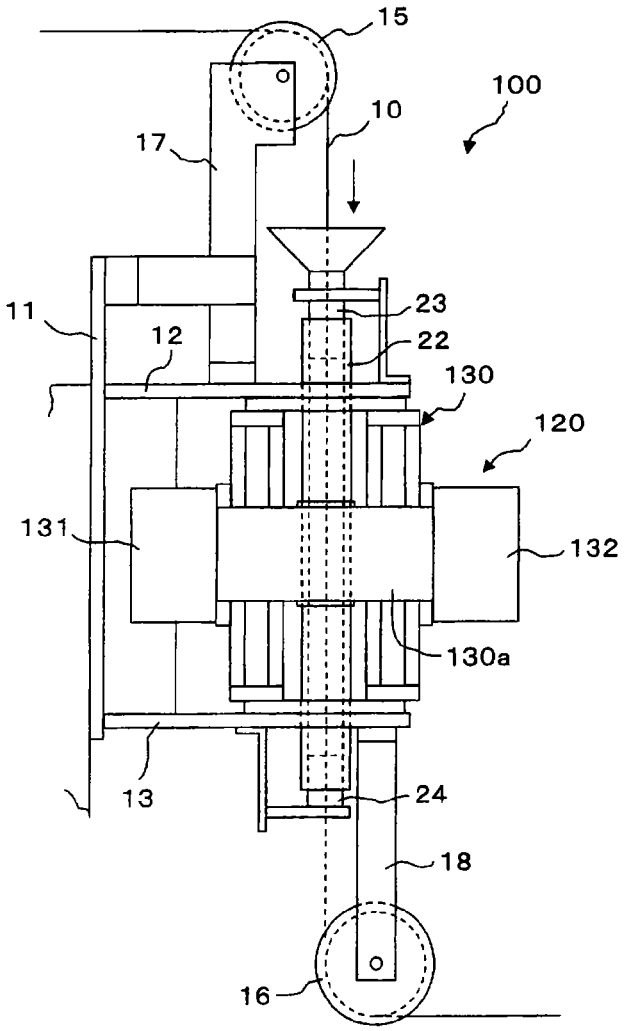
FIG. 5 is a table showing the mode in which a plurality of surface treatment units are repetitively subjected to pressing and release at different timings.
FIG. 6 is a view showing a surface treatment device for a long wirelike article in a second embodiment according to the present invention.

For example, as shown in FIG. 5, when the first surface treatment unit 20A is in release, the tube 22 is pressed by the second and third treatment units 20B, 20C at two places in the vertical direction. Then, when the second surface treatment unit 20B turns into release, the tube 22 is pressed by the first and third surface treatment units 20A, 20C. Further, when the third surface treatment unit 20C turns into release, the tube 22 is pressed by the first and second surface treatment units 20A, 20B.

In this way, there is taken a construction that either one of the first to third surface treatment units 20A-20C is held in release at all times, while the tube 22 is pressed in turn by two of the surface treatment units at all times. The cycle (Δt) for release is preferable to be at 0.2 to 2 seconds or so for example.

Thus, the long wirelike article 10 that goes through the powder 21 in the tube 22 at the predetermined speed is ground at the surface thereof with the power powder 21 filled in the tube 22, through the pressing and release operations of the tube 22 by the surface treatment units 20A-20C.

Particularly, since the tube 22 is cyclically pressed by the surface treatment units 20A-20C, the surface of the long wirelike article 10 can be ground most effectively when the force by the pressing begins to be exerted on the tube 22. Further, since the tube 22 is cyclically released, the fluidity of the powder 21 filled in the tube 22 is enhanced, so that fine powder fragmented by the grinding from the powder 21 and extraneous matter cut away from the surface of the long wirelike article 10 flow downward with the movement of the long wirelike article 10. Consequently, the surface of the long wirelike article 10 is ground with the fresh powder 21 being always good in sharpness, so that the grinding efficiency can be enhanced.

Next, the operation in the aforementioned embodiment will be described.

The long wirelike article 10 is moved by the feed means 19 in the tube 22 filled with the powder 21 at the predetermined speed in the arrowed direction in FIG. 1. In the first surface treatment unit 20A, the pair of air cylinders 31, 32 are cyclically moved back and forth, and the tube 22 is pressed by the pressing members 33, 34 at the forward movements of the air cylinders 31, 32 and at the same time, is restrained by the restriction members 35, 36 from expanding in a direction orthogonal to the pressing direction. Thus, since the tube 22 is pressed almost over the whole circumference, the powder 21 filled in the tube 22 and the surface of the long wirelike article 10 are pressed uniformly, so that the surface of the long wirelike article 10 is ground with the powder 21.

Further, at the retractions of the air cylinders 31, 32 in the first surface treatment unit 20A, the pressing operation of the tube 22 is released, and this causes fine power fragmented by the grinding from the powder 21 and the extraneous matter cut away from the surface of the long wirelike article 10 to flow downward with the movement of the long wirelike article 10. Therefore, the surface of the long wirelike article 10 is ground by the powder 21 being always good in sharpness, so that the grinding efficiency can be enhanced.

The powder 21 including the fine power and the extraneous matter that flow downward with the movement of the long wirelike article 10 is discharged from the discharge pipe 24 by way of the tube 22. On the other hand, the powder 21 is properly replenished from the powder tank to the supply pipe 23, and the tube 22 is kept in the state that the powder 21 is filled always throughout the entire length of the tube 22.

The long wirelike article 10 that has gone through the first surface treatment unit 20A is fed in turn into the tube 22 located inside the second surface treatment unit 20B and the third surface treatment unit 20C and is ground at the surface thereof in the same manner as aforementioned by the cyclic advance and retraction movements of the respective air cylinders 31, 32 in the second and third surface treatment units 20B, 20C. At this time, since the respective air cylinders 31, 32 in the second and third surface treatment units 20B, 20C are arranged to be shifted at the interval of the predetermined angle (120 degree) relative to the air cylinders 31, 32 in the first surface treatment unit 20A, the places at which the tube 22 is pressed particularly strongly by the pressing members 33, 34 change in the circumferential direction, so that the long wirelike article 10 can be ground uniformly in the circumferential direction.

In addition, the advance and retraction movements of the respective air cylinders 31, 32 in the first to third surface treatment units 20A-20C are cyclically repeated at the different timings as shown in FIG. 5, and thus, it becomes possible that even if not ground sufficiently in the first surface treatment unit 20A, the long wirelike article 10 can be ground completely by the grinding operations in the second and third surface treatment units 20B, 20C over the entire length thereof.

Accordingly, even if the long wirelike article 10 is fed by the feed means 19 at a comparatively fast feed speed such as, for example, 100 m/min or over, the long wirelike article 10 can be accurately ground without having oxide films remaining on the surface of the long wirelike article 10.

According to the aforementioned first embodiment, by the provision of the plurality of surface treatment units 20A-20C that cyclically press and release the elastic tube 22 filled with the powder 21, the fine powder fragmented by the grinding from the powder 21 and the extraneous matter cut away from the surface of the long wirelike article 10 can be enhanced in fluidity by the cyclic release operation of the tube 22. Therefore, it is possible to efficiently ground the surface of the long wirelike article 10 with the powder being always good in sharpness.

In addition, the cyclic pressing of the tube 22 makes it possible to grind the surface of the long wirelike article 10 most efficiently at the time of the pressing. Therefore, it becomes possible to perform the surface treatment with the powder 21 on the long wirelike article 10 further efficiently.

Further, the respective cylinders 31, 32 in the plurality of surface treatment units 20A-20C are constructed to be pressed and released at the timings shifted from one another. Thus, even if not ground sufficiently in one surface treatment unit, it becomes possible to grind the long wirelike article 10 completely over the entire length by the grinding operations in other surface treatment units.

Furthermore, since the respective cylinders 31, 32 of the plurality of surface treatment units 20A-20C are arranged to be shifted at the different angles around the tube 22, the places at which the pressing members 33, 34 of the cylinders 31, 32 press the tube 22 are changed in turn in the circumferential direction. Therefore, it becomes possible to grind the long wirelike article 10 uniformly in the circumferential direction.

FIG. 6 shows a second embodiment according to the present invention, and the point differing from the foregoing first embodiment resides in that one surface treatment unit 120 operates to remove oxide films adhered to the surface of the long wirelike article 10. The same components as those in the first embodiment are given the same reference numerals and will be omitted from being described.

Similarly to the aforementioned, the surface treatment unit 120 is provided with a unit main body 130 through which the tube 22 filled with the powder 21 (refer to FIGS. 2 and 3) passes, and air cylinders 131, 132 for pressing the tube 22 from both sides. The cylinders 131, 132 are cyclically advanced and retreated in synchronized relation with each other. The piston rods of the air cylinders 131, 132 have the pressing members (33, 34) attached thereto likewise in the first embodiment, and the restriction members (35, 36) for restricting the expansion of the tube 22 are arranged in the direction orthogonal to the pressing members (33, 34).

The pressing members (33, 34) and the restriction members (35, 36) are elongated to be long in the extending direction of the tube 22, so that the tube 22 is pressed over a wider area in the axial direction than that in the first embodiment. The lengths of the pressing members (33, 34) and the restriction members (35, 36) are determined in dependence on the moving speed of the long wirelike article 10 so that the already pressed portion of the long wirelike article 10 moved in the tube 22 does not go beyond the pressing members 33, 34 while the tube 22 is released.

This results in that the whole surface in the circumferential direction of the long wirelike article 10 is ground at least once with the powder 21 by the pressing operation of the tube 22. In addition, while the tube 22 is released, in the same manner as mentioned above, the fine powder fragmented by the grinding from the powder 21 and the extraneous matter cut away from the surface of the long wirelike article 10 flow downward with the movement of the long wirelike article 10. Consequently, the surface of the long wirelike article 10 can be ground with the powder 21 being good in sharpness.

According to the second embodiment, since the construction is taken that the long wirelike article 10 is subjected to the surface treatment by the single surface treatment unit 120, not only the same effects as those described in the first embodiment can be attained but also the surface treatment device 100 can be downsized and lightened to be thus reduced in manufacturing cost.

In the aforementioned embodiments, although description has been made regarding the example that the pressing members 33, 34 which press and release the tube 22 filled with the powder 21 are cyclically advanced and retreated by the cylinders 31, 32, it is possible to cyclically advance and retreat the pressing members 33, 34 by eccentric cams. In this case, the pressing members can be pressed and released by the continuous rotations in one direction of the eccentric cams by motors.

Further, although in the aforementioned embodiments, the tube 22 is pressed from both sides by the pressing members 33, 34 operated by the cylinders 31, 32, there may be taken a construction that a pressing chamber is provided around the tube 22 and that the supply and discharge of pressurized fluid with the pressing chamber are repeated alternately to press the tube 22 from therearound.

As described above, the present invention has been described based on the embodiments. However, the present invention is not limited to the constructions described in the embodiments and may take various forms without departing from the gist of the present invention described in the claims.

INDUSTRIAL APPLICABILITY

A surface treatment device and a surface treatment method for a long wirelike article according to the present invention are suitable for use in removing oxide films which adhered to the surface of the long wirelike article through a heat treatment.

The invention claimed is:

1. A surface treatment device for a long wirelike article to perform a surface treatment on a long wirelike article capable of movably passing through powder that is filled in an elastic tube to be supplied to and discharged from the tube, the surface treatment device comprising:

at least one surface treatment unit, wherein the surface treatment unit comprises:

the tube filled with the powder that can be supplied to and discharged from the tube, the long wirelike article capable of movably passing through the powder in the tube;

a pressing mechanism that cyclically repeats pressing and release of the tube; and a feed mechanism that moves the long wirelike article passing through the powder, wherein the pressing mechanism comprises:

a pair of cylinders that presses and compresses the tube and are arranged to face the tube put therebetween;

pressing members operated by the cylinders to press the tube from both one side and another side; and restriction members arranged in a direction crossing a pressing direction of the pressing members to restrict an expansion of the tube.

2. The surface treatment device in claim 1, wherein:

the at least one surface treatment unit comprises a plurality of surface treatment units arranged in a longitudinal direction of the tube; and respective of the pressing mechanisms in the surface treatment units are constructed to be subjected to pressing and release at mutually different timings.

3. The surface treatment device in claim 2, wherein a respective one of the pair of cylinders is arranged in a respective one of the plurality of surface treatment units to be shifted at an interval of a predetermined angle relative to the respective one of the cylinders around the tube.

4. A surface treatment method for a long wirelike article to perform a surface treatment on the long wirelike article capable of movably passing through powder that is filled in an elastic tube to be supplied to and discharged from the tube through a surface treatment unit having a pressing mechanism that cyclically presses and releases the tube and a feed mechanism that moves the long wirelike article capable of passing through the powder, the surface treatment method comprising:

cyclically repeating pressing and release of the tube to grind a surface of the long wirelike article with the powder filled in the tube by pressing the tube from both one side and another side and restricting an expansion of the tube in a direction crossing a pressing direction.

5. The surface treatment device in claim 1, wherein:

the feed mechanism moves the long wirelike article passing through the powder at a predetermined speed and, each length of the pressing members and the restriction members is determined in dependence on a moving speed of the long wirelike article so that an already pressed portion of the long wirelike article moved in the tube does not go beyond the pressing members, while the tube is released.

6. The surface treatment method of claim 4, wherein the pressing and the release of the tube is repeated at a cycle of 2 seconds or less.

7. The surface treatment device in claim 1, wherein the pressing and the release of the tube is repeated at a cycle of 2 seconds or less.

* * * * *